US005517765A

United States Patent [19]

Christansen

[11] Patent Number: 5,517,765

[45] Date of Patent: May 21, 1996

[54] DRYER SECTION APPARATUS

[75] Inventor: Brian A. Christansen, Clinton, Wis.

[73] Assignee: Beloit Technologies, Inc., Wilmington, Del.

[21] Appl. No.: 192,219

[22] Filed: Feb. 4, 1994

[51] Int. Cl.[6] ..... D06F 58/00

[52] U.S. Cl. ..... 34/116; 34/123

[58] Field of Search ..... 34/114, 115, 116, 34/117, 120, 123

[56] References Cited

U.S. PATENT DOCUMENTS

| | | | |
|---|---|---|---|
| 1,606,310 | 11/1926 | McCorkindale | 34/116 |
| 4,876,803 | 10/1989 | Wedel | 34/116 |
| 4,982,513 | 1/1991 | Loser et al. | 34/116 |
| 5,232,554 | 8/1993 | Kotitschke . | |
| 5,269,074 | 12/1993 | Sims et al. | 34/120 |
| 5,311,672 | 5/1994 | Kotitschke et al. . | |

FOREIGN PATENT DOCUMENTS

| | | |
|---|---|---|
| 4037661 | 12/1991 | Germany . |
| 4218595 | 12/1993 | Germany . |
| 4416585 | 10/1994 | Germany . |

OTHER PUBLICATIONS

G. Wedel et al, 'Trockenpartie–Konzept . . . ', Whole Document Das Papier, vol. 43, #10a (Oct. 1989).

W. Haessmer, 'Trocknungstechnik und deren . . . ', pp. V155–V163 Das Papier, vol. 44, #10a (Oct. 1990).

G. Wedel et al, 'Advances in dryer . . . ' pp. 65–69 Tappi Journal, vol. 70, #9 (Sep. 1987).

*Primary Examiner*—Henry A. Bennet
*Assistant Examiner*—Susanne C. Tinker
*Attorney, Agent, or Firm*—Dirk J. Veneman; Raymond W. Campbell; David J. Archer

[57] ABSTRACT

A dryer section apparatus as disclosed for drying a web of paper. The apparatus includes a plurality of dryer groups disposed successively relative to one another, such that the web is progressively dried during movement thereof through the dryer groups. The plurality of groups include a first single-tier group for drying the first side of the web, and a second two-tier group disposed downstream relative to the first group. A second single-tier group is disposed downstream relative to the two-tier group for restraining the web against cross machine directional shrinkage.

7 Claims, 1 Drawing Sheet

DRYER SECTION APPARATUS

BACKGROUND OF THE INVENTION

1. Field of the Invention

The present invention relates to a dryer section apparatus for drying a web of paper. More specifically, the present invention relates to a dryer section apparatus which includes a single-tier group.

2. Information Disclosure Statement

A revolutionary concept in drying technology was disclosed in U.S. Pat. No. 4,934,067. The aforementioned '067 patent described a singe-tier drying group followed by an inverted single-tier group for drying the opposite side of the web. The aforementioned arrangement committed alternate sides of the web to be dried while maximizing the drying effect of each dryer within a dryer group.

However, in certain applications, it is desirable to reduce the overall length of the dryer section apparatus such being the case particularly when rebuilding a dryer section such that the building of additional mill space is avoided.

More specifically, on light-weight grade papers, the aforementioned arrangement of the '067 patent has achieved enormous commercial application. However, on heavier weight grades and board production, it has been discovered that sheet restraint will be particularly required only in the downstream or dry end of the dryer section. Such is the case because at the wet end or upstream end of the dryer section, although much of the water is removed at this end, comparatively little shrinkage takes place. Moreover, the majority of shrinkage takes place at the dry end or downstream end of the dryer section.

Accordingly, the present invention envisages the insertion of a two-tier dryer section between an upstream and a downstream single-tier group. Thus, reducing the overall length of the dryer section apparatus while maintaining the essential feature of cross machine directional restraint of the web at the dry end of the dryer section apparatus.

Accordingly, a primary objective of the present invention is the provision of the dryer section apparatus which overcomes the aforementioned problems associated with the prior art arrangement, and which makes a significant contribution to the art of drying a web of paper.

Another object of the present invention is the provision of a dryer section apparatus having a reduced overall length by the substitution of a two-tier dryer group between an upstream and a downstream single-tier group.

Other objects and advantages of the present invention will be readily apparent to those skilled in the art by consideration of the detailed description contained hereinafter, taken in conjunction with the annexed drawings.

SUMMARY OF THE INVENTION

The present invention relates to a dryer section apparatus for drying a web of paper. The apparatus includes a plurality of dryer groups disposed successively relative to one an other such that the web is progressively dried during movement thereof through the dryer groups. The plurality of groups include a first single-tier group for drying a first side of the web and a two-tier group disposed downstream relative to the first group.

Additionally, a second single-tier group is disposed downstream relative to the two-tier group for restraining the web against cross machine directional shrinkage.

In a further embodiment of the present invention, the dryer section apparatus includes a further single-tier group which is disposed between the first single-tier group and the two-tier group for drying a second side of the web.

In yet another embodiment of the present invention, the dryer section apparatus includes a further single-tier group which is disposed between the two-tier group and the second single-tier group. The further single-tier group and the second single-tier group dry opposite sides of the web.

Many modifications and variations of the present invention will be readily apparent to those skilled in the art by a consideration of the detailed description contained hereinafter, taken in conjunction with the annexed drawings. However, such modifications and variations do not depart from the scope of the present invention, as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
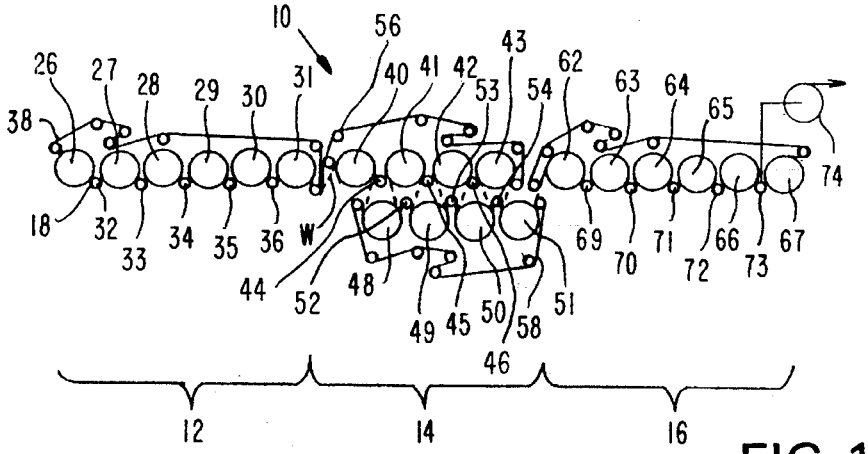
FIG. 1 is a side-elevational view of a dryer section apparatus according to the present invention.

FIG. 1 is a side-elevational view of a dryer section apparatus generally designated 10 for drying a web of paper W according to the present invention. progressively dried during movement thereof through the dryer groups 12, 14 and 16.

The plurality of groups 12, 14 and 16 include a first single-tier group 12 for drying a first side 18 of the web W.

A two-tier group 14 is disposed downstream relative to the first group 12.

A second single-tier group 16 is disposed downstream relative to the two-tier group 14 for restraining the web W against cross machine directional shrinkage.

Figure 2:
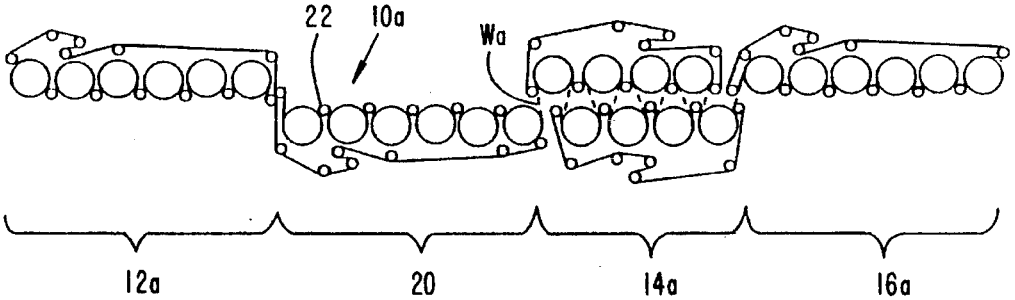
FIG. 2 is a side-elevational view of another embodiment of the present invention.

FIG. 2 is a side-elevational view of a further embodiment of the present invention in which a dryer section apparatus generally designated 10A further includes a further single-tier group 20 disposed between a first single-tier group 12A and a two-tier group 14A for drying a second side 22 of the web WA.

Figure 3:
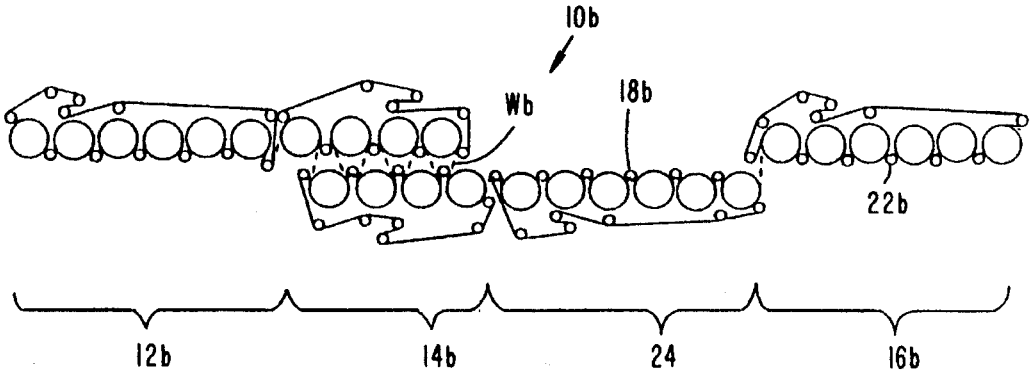
FIG. 3 is a side-elevational view of yet another embodiment of the present invention.

FIG. 3 is a side-elevational view of yet another embodiment of the present invention. FIG. 3 shows a dryer section apparatus generally designated 10B. The apparatus 10B includes a further single-tier group generally designated 24 disposed between a two-tier group 14B and a second single-tier group 16B. The further single-tier group 24 and the second single-tier group 16B dry opposite sides 18B and 22B of the web WB.

The first single-tier group 12 includes a first plurality of drying cylinders 26, 27, 28, 29, 30 and 31.

Additionally, the first group 12 includes a first plurality of vacuum rolls 32, 33 34, 35 and 36, with each vacuum roll 32–36 being disposed between adjacent drying cylinders 26–31 of the first plurality of drying cylinders. For example, vacuum roll 32 is disposed between adjacent drying cylinders 26 and 27.

A first dryer felt 38 is looped around each drying cylinder 26 to 31 and each vacuum roll 32 to 36 of the first single-tier group 12. The arrangement is such that the first single-tier group 12 is top felted for facilitating broke removal.

The two-tier group 14 includes a first row of drying cylinders 40, 41,42 and 43, and a first plurality of guide rolls 44, 45 and 46. Each guide roll 44 to 46 is disposed between an adjacent drying cylinder 40 to 43 of the first row of drying cylinders.

A second row of drying cylinders 48, 49, 50 and 51, and a second plurality of guide rolls 52, 53 and 54 are arranged such that each of the guide rolls 52 to 54 are disposed between adjacent drying cylinders 48 to 51 of the second row of drying cylinders.

A top felt 56 is looped around each drying cylinder 40 to 43 and guide roll 44 to 46 of the first row.

Similarly, a bottom felt 58 is looped around each drying cylinder 48–51 and guide roll 52–54 of the second row such that the web W extends in open draw between the drying cylinders of the first and second row of drying cylinders, respectively.

Figure 4:
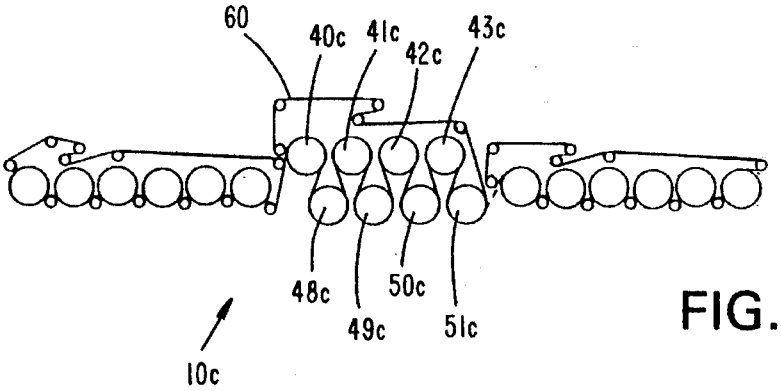
FIG. 4 is a side-elevational view of a further embodiment of the invention.

FIG. 4 is a side-elevational view which is similar to the view shown in FIG. 1 but shows yet another embodiment of the present invention in which the two-tier group is a single-felted group 14C. More specifically, the two-tier group includes an upper and a lower row of drying cylinders 40C–43C and 48C–51C, respectively. A dryer felt 60 extends in sinusoidal configuration around each drying cylinder of the upper and lower row of the drying cylinders.

As shown in FIG. 1, the second single-tier group also includes a plurality of drying cylinders 62, 63, 64, 65, 66 and 67. A dryer felt 68 is looped around the drying cylinders 62 to 67.

Additionally, a plurality of vacuum rolls 69, 70, 71, 72 and 73 are arranged such that each vacuum roll is disposed between adjacent drying cylinders 62–67 of the second single-tier group 16. With the vacuum rolls 69–73 being connected to a source of partial vacuum 74, such that the web W is drawn into close conformity with the dryer felt 68 during movement of the web around each vacuum roll 69–73, such that the web is restrained against cross machine directional shrinkage.

In operation of the dryer section apparatus according to the present invention, the web is initially dried at the wet end of the dryer section apparatus by means of the first single-tier group 12, which is top felted. Most web breakages occur at the wet end of the dryer section apparatus. Therefore, by top felting the first single-tier group, downward removal of broke is facilitated while maximizing the drying effect of each dryer cylinder.

Drying the web in the two-tier group 14 enables an overall reduction in the length of the resultant dryer section apparatus 10, and does not unduly or adversely effect the properties of the web because generally the amount of cross machine directional shrinkage during passage through the two-tier group 14 is minimal. Furthermore, the web has dried sufficiently during passage through the first group 12, in order to attain sufficient strength such that web breakage and/or web flutter in the second group 14, particularly with heavier grades, is minimal.

The second single-tier group 16 restrains the web against cross machine directional shrinkage, particularly because such shrinkage occurs mainly at the dry end of the dryer section apparatus. Accordingly, the majority of web shrinkage occurs during passage through the second single-tier group 16 and the high vacuum applied to the vacuum rolls 69–73 in addition to the restraint of the felt 68 while passing around each drying cylinder results in minimal cross machine directional shrinkage. The high vacuum should be at least 6" WC as taught in U.S. Pat. No. 5,279,049, which is incorporated herein by reference.

In the present invention, the term single-tier is not limited to an arrangement in which each drying cylinder in a group is disposed with a common plane extending through each of the rotational axes of the cylinders.

The present invention provides a drying apparatus which permits reduction in cross machine directional shrinkage, and also the advantage of the production of a wider web, because the single-tier groups do not require threading ropes.

Additionally, the overall length of the resultant apparatus is minimal.

I claim:

1. A dryer section apparatus for drying a web of paper, said apparatus comprising:

a plurality of dryer groups disposed successively relative to one another such that the web is progressively dried during movement thereof through said dryer groups;

said plurality of groups including:

a first single-tier group for drying a first side of the web;

a two-tier group disposed downstream relative to said first group;

a second single-tier group disposed downstream relative to said two-tier group for restraining the web against cross machine directional shrinkage during movement of the web through said second group;

said second single-tier group further including:

a plurality of drying cylinders:

a dryer felt looped around said drying cylinders; and a plurality of vacuum rolls, each vacuum roll being disposed between adjacent drying cylinders of said second single tier group, said vacuum rolls being connected to a source of partial vacuum such that the web is drawn into close conformity with said dryer felt during movement of the web around each vacuum roll, such that the web is restrained against cross-machine directional shrinkage.

2. A dryer section apparatus as set forth in claim 1 further including:

a further single-tier group disposed between said first single-tier group and said two-tier group for drying a second side of the web.

3. A dryer section apparatus as set forth in claim 1 further including:

a further single-tier group disposed between said two-tier group and said second single-tier group, said further single-tier group and said second single-tier group drying opposite sides of the web.

4. A dryer section apparatus as set forth in claim 1 wherein said first single-tier group includes:

a first plurality of drying cylinders;

a first plurality of vacuum rolls, each vacuum roll being disposed between adjacent drying cylinders of said first plurality of drying cylinders.

5. A dryer section apparatus as set forth in claim 4 further including:

a first dryer felt looped around each drying cylinder and each vacuum roll of said first single-tier group, the arrangement being such that the first single-tier group is top felted for facilitating broke removal.

6. A dryer section apparatus as set forth in claim 1 wherein said two-tier group includes:

a first row of drying cylinders;

a first plurality of guide rolls, each guide roll being disposed between an adjacent drying cylinder of said first row of drying cylinders;

a second row of drying cylinders;

a second plurality of guide rolls, each guide roll of said second plurality of guide rolls being disposed between adjacent drying cylinders of said second row of drying cylinders;

a top felt looped around each drying cylinder and guide roll of said first row;

a bottom felt looped around each drying cylinder and guide roll of said second row, such that the web extends in open draw between said drying cylinders of said first and second row of drying cylinders.

7. A dryer section apparatus as set forth in claim 1, wherein said two-tier group includes:

an upper and a lower row of drying cylinders;

a dryer felt extending in sinusoidal configuration around each drying cylinder of said upper and the lower row of drying cylinders.

* * * * *

UNITED STATES PATENT AND TRADEMARK OFFICE

CERTIFICATE OF CORRECTION

PATENT NO. : 5,517,765

DATED : 05/21/96

INVENTOR(S) : Christiansen

It is certified that error appears in the above-indentified patent and that said Letters Patent is hereby corrected as shown below:

On the title page, item [75]:

INVENTOR: "Christansen" should read --Christiansen--.

Column 2, line 37: --The dryer section apparatus 10 includes a plurality of dryer groups 12, 14 and 16 disposed successively relative to one another such that the web W is-- should be inserted before "progressively".

Signed and Sealed this

Twentieth Day of May, 1997

Bruce Lehman

*Attest:*

BRUCE LEHMAN

*Attesting Officer*

*Commissioner of Patents and Trademarks*